US007412792B2

(12) United States Patent
Hale

(10) Patent No.: US 7,412,792 B2
(45) Date of Patent: Aug. 19, 2008

(54) MOUNTING AND FRAMING SYSTEM AND APPARATUS

(76) Inventor: George Hale, 45 Pine St., Apt. #3, Waterbury, CT (US) 06710

( * ) Notice: Subject to any disclaimer, the term of this patent is extended or adjusted under 35 U.S.C. 154(b) by 186 days.

(21) Appl. No.: 11/292,900

(22) Filed: Dec. 3, 2005

(65) Prior Publication Data

US 2007/0124976 A1 Jun. 7, 2007

(51) Int. Cl.
*A47G 1/06* (2006.01)

(52) U.S. Cl. ..... 40/791; 40/790; 40/740; 40/771

(58) Field of Classification Search ..... 40/743, 40/791, 615, 768, 769, 771, 790, 792, 798, 40/794, 737; 38/102.04
See application file for complete search history.

(56) References Cited

U.S. PATENT DOCUMENTS

| | | | | |
|---|---|---|---|---|
| 224,973 | A * | 2/1880 | Wallis | 40/737 |
| 509,626 | A * | 11/1893 | Patterson | 40/790 |
| 764,273 | A * | 7/1904 | Denton et al. | 40/771 |
| 2,556,798 | A | 6/1951 | Concordet | |
| 3,314,180 | A | 4/1967 | Porter | |
| 3,653,707 | A * | 4/1972 | Pile et al. | 294/67.1 |
| 4,047,612 | A * | 9/1977 | Lohmann | 206/454 |
| 4,204,350 | A * | 5/1980 | Brenner | 40/790 |
| 4,525,945 | A * | 7/1985 | Shultz | 40/785 |
| 4,794,714 | A | 1/1989 | Weisgerber | |
| 5,012,600 | A * | 5/1991 | Wang | 40/737 |
| 5,371,963 | A | 12/1994 | Gallagher | |
| 5,383,293 | A | 1/1995 | Royal | |
| 6,640,476 | B1 | 11/2003 | Miller | |

* cited by examiner

*Primary Examiner*—Lesley D. Morris
*Assistant Examiner*—Christopher E Veraa
(74) *Attorney, Agent, or Firm*—McCormick, Paulding & Huber LLP

(57) ABSTRACT

A mounting and framing apparatus and system are disclosed in which displayed items such as graphics, photographs, mattes, paintings or the like are positioned between multiple transparent plates of glass or plastic to impart a sense of depth thereto, clamping bars apply a compressive force to the transparent plates for holding the displayed items in place, and decorative members are provided for adding aesthetic appeal.

10 Claims, 9 Drawing Sheets

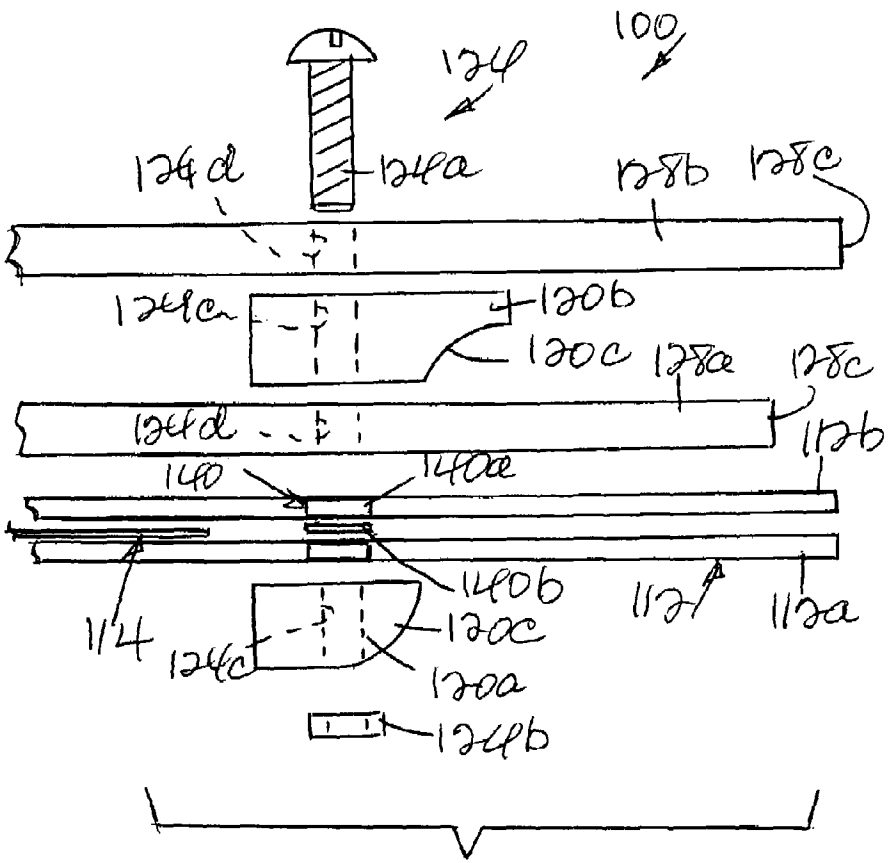
100
124
124a
124b
124c
124d
124e
126
126a
126b
126c
126d
126e
128
128a
128b
128c
128d
128e
130
130a
130b
130c
130d
130e
130f
130g
130h
130i
130j
130k
130l
130m
130n
130o
130p
130q
130r
130s
130t
130u
130v
130w
130x
130y
130z
130aa
130ab
130ac
130ad
130ae
130af
130ag
130ah
130ai
130aj
130ak
130al
130am
130an
130ao
130ap
130aq
130ar
130as
130at
130au
130av
130aw
130ax
130ay
130az
130ba
130bb
130bc
130bd
130be
130bf
130bg
130bh
130bi
130bj
130bk
130bl
130bm
130bn
130bo
130bp
130bq
130br
130bs
130bt
130bu
130bv
130bw
130bx
130by
130bz
130ca
130cb
130cc
130cd
130ce
130cf
130cg
130ch
130ci
130cj
130ck
130cl
130cm
130cn
130co
130cp
130cq
130cr
130cs
130ct
130cu
130cv
130cw
130cx
130cy
130cz
130da
130db
130dc
130dd
130de
130df
130dg
130dh
130di
130dj
130dk
130dl
130dm
130dn
130do
130dp
130dq
130dr
130ds
130dt
130du
130dv
130dw
130dx
130dy
130dz
130ea
130eb
130ec
130ed
130ee
130ef
130eg
130eh
130ei
130ej
130ek
130el
130em
130en
130eo
130ep
130eq
130er
130es
130et
130eu
130ev
130ew
130ex
130ey
130ez
130fa
130fb
130fc
130fd
130fe
130ff
130fg
130fh
130fi
130fj
130fk
130fl
130fm
130fn
130fo
130fp
130fq
130fr
130fs
130ft
130fu
130fv
130fw
130fx
130fy
130fz
130ga
130gb
130gc
130gd
130ge
130gf
130gg
130gh
130gi
130gj
130gk
130gl
130gm
130gn
130go
130gp
130gq
130gr
130gs
130gt
130gu
130gv
130gw
130gx
130gy
130gz
130ha
130hb
130hc
130hd
130he
130hf
130hg
130hh
130hi
130hj
130hk
130hl
130hm
130hn
130ho
130hp
130hq
130hr
130hs
130ht
130hu
130hv
130hw
130hx
130hy
130hz
130ia
130ib
130ic
130id
130ie
130if
130ig
130ih
130ii
130ij
130ik
130il
130im
130in
130io
130ip
130iq
130ir
130is
130it
130iu
130iv
130iw
130ix
130iy
130iz
130ja
130jb
130jc
130jd
130je
130jf
130jg
130jh
130ji
130jj
130jk
130jl
130jm
130jn
130jo
130jp
130jq
130jr
130js
130jt
130ju
130jv
130jw
130jx
130jy
130jz
130ka
130kb
130kc
130kd
130ke
130kf
130kg
130kh
130ki
130kj
130kk
130kl
130km
130kn
130ko
130kp
130kq
130kr
130ks
130kt
130ku
130kv
130kw
130kx
130ky
130kz
130la
130lb
130lc
130ld
130le
130lf
130lg
130lh
130li
130lj
130lk
130ll
130lm
130ln
130lo
130lp
130lq
130lr
130ls
130lt
130lu
130lv
130lw
130lx
130ly
130lz
130ma
130mb
130mc
130md
130me
130mf
130mg
130mh
130mi
130mj
130mk
130ml
130mm
130mn
130mo
130mp
130mq
130mr
130ms
130mt
130mu
130mv
130mw
130mx
130my
130mz
130na
130nb
130nc
130nd
130ne
130nf
130ng
130nh
130ni
130nj
130nk
130nl
130nm
130nn
130no
130np
130nq
130nr
130ns
130nt
130nu
130nv
130nw
130nx
130ny
130nz
130oa
130ob
130oc
130od
130oe
130of
130og
130oh
130oi
130oj
130ok
130ol
130om
130on
130oo
130op
130oq
130or
130os
130ot
130ou
130ov
130ow
130ox
130oy
130oz
130pa
130pb
130pc
130pd
130pe
130pf
130pg
130ph
130pi
130pj
130pk
130pl
130pm
130pn
130po
130pp
130pq
130pr
130ps
130pt
130pu
130pv
130pw
130px
130py
130pz
130qa
130qb
130qc
130qd
130qe
130qf
130qg
130qh
130qi
130qj
130qk
130ql
130qm
130qn
130qo
130qp
130qq
130qr
130qs
130qt
130qu
130qv
130qw
130qx
130qy
130qz
130ra
130rb
130rc
130rd
130re
130rf
130rg
130rh
130ri
130rj
130rk
130rl
130rm
130rn
130ro
130rp
130rq
130rr
130rs
130rt
130ru
130rv
130rw
130rx
130ry
130rz
130sa
130sb
130sc
130sd
130se
130sf
130sg
130sh
130si
130sj
130sk
130sl
130sm
130sn
130so
130sp
130sq
130sr
130ss
130st
130su
130sv
130sw
130sx
130sy
130sz
130ta
130tb
130tc
130td
130te
130tf
130tg
130th
130ti
130tj
130tk
130tl
130tm
130tn
130to
130tp
130tq
130tr
130ts
130tt
130tu
130tv
130tw
130tx
130ty
130tz
130ua
130ub
130uc
130ud
130ue
130uf
130ug
130uh
130ui
130uj
130uk
130ul
130um
130un
130uo
130up
130uq
130ur
130us
130ut
130uu
130uv
130uw
130ux
130uy
130uz
130va
130vb
130vc
130vd
130ve
130vf
130vg
130vh
130vi
130vj
130vk
130vl
130vm
130vn
130vo
130vp
130vq
130vr
130vs
130vt
130vu
130vv
130vw
130vx
130vy
130vz
130wa
130wb
130wc
130wd
130we
130wf
130wg
130wh
130wi
130wj
130wk
130wl
130wm
130wn
130wo
130wp
130wq
130wr
130ws
130wt
130wu
130wv
130ww
130wx
130wy
130wz
130xa
130xb
130xc
130xd
130xe
130xf
130xg
130xh
130xi
130xj
130xk
130xl
130xm
130xn
130xo
130xp
130xq
130xr
130xs
130xt
130xu
130xv
130xw
130xx
130xy
130xz
130ya
130yb
130yc
130yd
130ye
130yf
130yg
130yh
130yi
130yj
130yk
130yl
130ym
130yn
130yo
130yp
130yq
130yr
130ys
130yt
130yu
130yv
130yw
130yx
130yy
130yz
130za
130zb
130zc
130zd
130ze
130zf
130zg
130zh
130zi
130zj
130zk
130zl
130zm
130zn
130zo
130zp
130zq
130zr
130zs
130zt
130zu
130zv
130zw
130zx
130zy
130zz
140
140a
140b
140c
140d
140e
140f
140g
140h
140i
140j
140k
140l
140m
140n
140o
140p
140q
140r
140s
140t
140u
140v
140w
140x
140y
140z
140aa
140ab
140ac
140ad
140ae
140af
140ag
140ah
140ai
140aj
140ak
140al
140am
140an
140ao
140ap
140aq
140ar
140as
140at
140au
140av
140aw
140ax
140ay
140az
140ba
140bb
140bc
140bd
140be
140bf
140bg
140bh
140bi
140bj
140bk
140bl
140bm
140bn
140bo
140bp
140bq
140br
140bs
140bt
140bu
140bv
140bw
140bx
140by
140bz
140ca
140cb
140cc
140cd
140ce
140cf
140cg
140ch
140ci
140cj
140ck
140cl
140cm
140cn
140co
140cp
140cq
140cr
140cs
140ct
140cu
140cv
140cw
140cx
140cy
140cz
140da
140db
140dc
140dd
140de
140df
140dg
140dh
140di
140dj
140dk
140dl
140dm
140dn
140do
140dp
140dq
140dr
140ds
140dt
140du
140dv
140dw
140dx
140dy
140dz
140ea
140eb
140ec
140ed
140ee
140ef
140eg
140eh
140ei
140ej
140ek
140el
140em
140en
140eo
140ep
140eq
140er
140es
140et
140eu
140ev
140ew
140ex
140ey
140ez
140fa
140fb
140fc
140fd
140fe
140ff
140fg
140fh
140fi
140fj
140fk
140fl
140fm
140fn
140fo
140fp
140fq
140fr
140fs
140ft
140fu
140fv
140fw
140fx
140fy
140fz
140ga
140gb
140gc
140gd
140ge
140gf
140gg
140gh
140gi
140gj
140gk
140gl
140gm
140gn
140go
140gp
140gq
140gr
140gs
140gt
140gu
140gv
140gw
140gx
140gy
140gz
140ha
140hb
140hc
140hd
140he
140hf
140hg
140hh
140hi
140hj
140hk
140hl
140hm
140hn
140ho
140hp
140hq
140hr
140hs
140ht
140hu
140hv
140hw
140hx
140hy
140hz
140ia
140ib
140ic
140id
140ie
140if
140ig
140ih
140ii
140ij
140ik
140il
140im
140in
140io
140ip
140iq
140ir
140is
140it
140iu
140iv
140iw
140ix
140iy
140iz
140ja
140jb
140jc
140jd
140je
140jf
140jg
140jh
140ji
140jj
140jk
140jl
140jm
140jn
140jo
140jp
140jq
140jr
140js
140jt
140ju
140jv
140jw
140jx
140jy
140jz
140ka
140kb
140kc
140kd
140ke
140kf
140kg
140kh
140ki
140kj
140kk
140kl
140km
140kn
140ko
140kp
140kq
140kr
140ks
140kt
140ku
140kv
140kw
140kx
140ky
140kz
140la
140lb
140lc
140ld
140le
140lf
140lg
140lh
140li
140lj
140lk
140ll
140lm
140ln
140lo
140lp
140lq
140lr
140ls
140lt
140lu
140lv
140lw
140lx
140ly
140lz
140ma
140mb
140mc
140md
140me
140mf
140mg
140mh
140mi
140mj
140mk
140ml
140mm
140mn
140mo
140mp
140mq
140mr
140ms
140mt
140mu
140mv
140mw
140mx
140my
140mz
140na
140nb
140nc
140nd
140ne
140nf
140ng
140nh
140ni
140nj
140nk
140nl
140nm
140nn
140no
140np
140nq
140nr
140ns
140nt
140nu
140nv
140nw
140nx
140ny
140nz
140oa
140ob
140oc
140od
140oe
140of
140og
140oh
140oi
140oj
140ok
140ol
140om
140on
140oo
140op
140oq
140or
140os
140ot
140ou
140ov
140ow
140ox
140oy
140oz
140pa
140pb
140pc
140pd
140pe
140pf
140pg
140ph
140pi
140pj
140pk
140pl
140pm
140pn
140po
140pp
140pq
140pr
140ps
140pt
140pu
140pv
140pw
140px
140py
140pz
140qa
140qb
140qc
140qd
140qe
140qf
140qg
140qh
140qi
140qj
140qk
140ql
140qm
140qn
140qo
140qp
140qq
140qr
140qs
140qt
140qu
140qv
140qw
140qx
140qy
140qz
140ra
140rb
140rc
140rd
140re
140rf
140rg
140rh
140ri
140rj
140rk
140rl
140rm
140rn
140ro
140rp
140rq
140rr
140rs
140rt
140ru
140rv
140rw
140rx
140ry
140rz
140sa
140sb
140sc
140sd
140se
140sf
140sg
140sh
140si
140sj
140sk
140sl
140sm
140sn
140so
140sp
140sq
140sr
140ss
140st
140su
140sv
140sw
140sx
140sy
140sz
140ta
140tb
140tc
140td
140te
140tf
140tg
140th
140ti
140tj
140tk
140tl
140tm
140tn
140to
140tp
140tq
140tr
140ts
140tt
140tu
140tv
140tw
140tx
140ty
140tz
140ua
140ub
140uc
140ud
140ue
140uf
140ug
140uh
140ui
140uj
140uk
140ul
140um
140un
140uo
140up
140uq
140ur
140us
140ut
140uu
140uv
140uw
140ux
140uy
140uz
140va
140vb
140vc
140vd
140ve
140vf
140vg
140vh
140vi
140vj
140vk
140vl
140vm
140vn
140vo
140vp
140vq
140vr
140vs
140vt
140vu
140vv
140vw
140vx
140vy
140vz
140wa
140wb
140wc
140wd
140we
140wf
140wg
140wh
140wi
140wj
140wk
140wl
140wm
140wn
140wo
140wp
140wq
140wr
140ws
140wt
140wu
140wv
140ww
140wx
140wy
140wz
140xa
140xb
140xc
140xd
140xe
140xf
140xg
140xh
140xi
140xj
140xk
140xl
140xm
140xn
140xo
140xp
140xq
140xr
140xs
140xt
140xu
140xv
140xw
140xx
140xy
140xz
140ya
140yb
140yc
140yd
140ye
140yf
140yg
140yh
140yi
140yj
140yk
140yl
140ym
140yn
140yo
140yp
140yq
140yr
140ys
140yt
140yu
140yv
140yw
140yx
140yy
140yz
140za
140zb
140zc
140zd
140ze
140zf
140zg
140zh
140zi
140zj
140zk
140zl
140zm
140zn
140zo
140zp
140zq
140zr
140zs
140zt
140zu
140zv
140zw
140zx
140zy
140zz
142
142a
142b
142c
142d
142e
142f
142g
142h
142i
142j
142k
142l
142m
142n
142o
142p
142q
142r
142s
142t
142u
142v
142w
142x
142y
142z
142aa
142ab
142ac
142ad
142ae
142af
142ag
142ah
142ai
142aj
142ak
142al
142am
142an
142ao
142ap
142aq
142ar
142as
142at
142au
142av
142aw
142ax
142ay
142az
142ba
142bb
142bc
142bd
142be
142bf
142bg
142bh
142bi
142bj
142bk
142bl
142bm
142bn
142bo
142bp
142bq
142br
142bs
142bt
142bu
142bv
142bw
142bx
142by
142bz
142ca
142cb
142cc
142cd
142ce
142cf
142cg
142ch
142ci
142cj
142ck
142cl
142cm
142cn
142co
142cp
142cq
142cr
142cs
142ct
142cu
142cv
142cw
142cx
142cy
142cz
142da
142db
142dc
142dd
142de
142df
142dg
142dh
142di
142dj
142dk
142dl
142dm
142dn
142do
142dp
142dq
142dr
142ds
142dt
142du
142dv
142dw
142dx
142dy
142dz
142ea
142eb
142ec
142ed
142ee
142ef
142eg
142eh
142ei
142ej
142ek
142el
142em
142en
142eo
142ep
142eq
142er
142es
142et
142eu
142ev
142ew
142ex
142ey
142ez
142fa
142fb
142fc
142fd
142fe
142ff
142fg
142fh
142fi
142fj
142fk
142fl
142fm
142fn
142fo
142fp
142fq
142fr
142fs
142ft
142fu
142fv
142fw
142fx
142fy
142fz
142ga
142gb
142gc
142gd
142ge
142gf
142gg
142gh
142gi
142gj
142gk
142gl
142gm
142gn
142go
142gp
142gq
142gr
142gs
142gt
142gu
142gv
142gw
142gx
142gy
142gz
142ha
142hb
142hc
142hd
142he
142hf
142hg
142hh
142hi
142hj
142hk
142hl
142hm
142hn
142ho
142hp
142hq
142hr
142hs
142ht
142hu
142hv
142hw
142hx
142hy
142hz
142ia
142ib
142ic
142id
142ie
142if
142ig
142ih
142ii
142ij
142ik
142il
142im
142in
142io
142ip
142iq
142ir
142is
142it
142iu
142iv
142iw
142ix
142iy
142iz
142ja
142jb
142jc
142jd
142je
142jf
142jg
142jh
142ji
142jj
142jk
142jl
142jm
142jn
142jo
142jp
142jq
142jr
142js
142jt
142ju
142jv
142jw
142jx
142jy
142jz
142ka
142kb
142kc
142kd
142ke
142kf
142kg
142kh
142ki
142kj
142kk
142kl
142km
142kn
142ko
142kp
142kq
142kr
142ks
142kt
142ku
142kv
142kw
142kx
142ky
142kz
142la
142lb
142lc
142ld
142le
142lf
142lg
142lh
142li
142lj
142lk
142ll
142lm
142ln
142lo
142lp
142lq
142lr
142ls
142lt
142lu
142lv
142lw
142lx
142ly
142lz
142ma
142mb
142mc
142md
142me
142mf
142mg
142mh
142mi
142mj
142mk
142ml
142mm
142mn
142mo
142mp
142mq
142mr
142ms
142mt
142mu
142mv
142mw
142mx
142my
142mz
142na
142nb
142nc
142nd
142ne
142nf
142ng
142nh
142ni
142nj
142nk
142nl
142nm
142nn
142no
142np
142nq
142nr
142ns
142nt
142nu
142nv
142nw
142nx
142ny
142nz
142oa
142ob
142oc
142od
142oe
142of
142og
142oh
142oi
142oj
142ok
142ol
142om
142on
142oo
142op
142oq
142or
142os
142ot
142ou
142ov
142ow
142ox
142oy
142oz
142pa
142pb
142pc
142pd
142pe
142pf
142pg
142ph
142pi
142pj
142pk
142pl
142pm
142pn
142po
142pp
142pq
142pr
142ps
142pt
142pu
142pv
142pw
142px
142py
142pz
142qa
142qb
142qc
142qd
142qe
142qf
142qg
142qh
142qi
142qj
142qk
142ql
142qm
142qn
142qo
142qp
142qq
142qr
142qs
142qt
142qu
142qv
142qw
142qx
142qy
142qz
142ra
142rb
142rc
142rd
142re
142rf
142rg
142rh
142ri
142rj
142rk
142rl
142rm
142rn
142ro
142rp
142rq
142rr
142rs
142rt
142ru
142rv
142rw
142rx
142ry
142rz
142sa
142sb
142sc
142sd
142se
142sf
142sg
142sh
142si
142sj
142sk
142sl
142sm
142sn
142so
142sp
142sq
142sr
142ss
142st
142su
142sv
142sw
142sx
142sy
142sz
142ta
142tb
142tc
142td
142te
142tf
142tg
142th
142ti
142tj
142tk
142tl
142tm
142tn
142to
142tp
142tq
142tr
142ts
142tt
142tu
142tv
142tw
142tx
142ty
142tz
142ua
142ub
142uc
142ud
142ue
142uf
142ug
142uh
142ui
142uj
142uk
142ul
142um
142un
142uo
142up
142uq
142ur
142us
142ut
142uu
142uv
142uw
142ux
142uy
142uz
142va
142vb
142vc
142vd
142ve
142vf
142vg
142vh
142vi
142vj
142vk
142vl
142vm
142vn
142vo
142vp
142vq
142vr
142vs
142vt
142vu
142vv
142vw
142vx
142vy
142vz
142wa
142wb
142wc
142wd
142we
142wf
142wg
142wh
142wi
142wj
142wk
142wl
142wm
142wn
142wo
142wp
142wq
142wr
142ws
142wt
142wu
142wv
142ww
142wx
142wy
142wz
142xa
142xb
142xc
142xd
142xe
142xf
142xg
142xh
142xi
142xj
142xk
142xl
142xm
142xn
142xo
142xp
142xq
142xr
142xs
142xt
142xu
142xv
142xw
142xx
142xy
142xz
142ya
142yb
142yc
142yd
142ye
142yf
142yg
142yh
142yi
142yj
142yk
142yl
142ym
142yn
142yo
142yp
142yq
142yr
142ys
142yt
142yu
142yv
142yw
142yx
142yy
142yz
142za
142zb
142zc
142zd
142ze
142zf
142zg
142zh
142zi
142zj
142zk
142zl
142zm
142zn
142zo
142zp
142zq
142zr
142zs
142zt
142zu
142zv
142zw
142zx
142zy
142zz
144
144a
144b
144c
144d
144e
144f
144g
144h
144i
144j
144k
144l
144m
144n
144o
144p
144q
144r
144s
144t
144u
144v
144w
144x
144y
144z
144aa
144ab
144ac
144ad
144ae
144af
144ag
144ah
144ai
144aj
144ak
144al
144am
144an
144ao
144ap
144aq
144ar
144as
144at
144au
144av
144aw
144ax
144ay
144az
144ba
144bb
144bc
144bd
144be
144bf
144bg
144bh
144bi
144bj
144bk
144bl
144bm
144bn
144bo
144bp
144bq
144br
144bs
144bt
144bu
144bv
144bw
144bx
144by
144bz
144ca
144cb
144cc
144cd
144ce
144cf
144cg
144ch
144ci
144cj
144ck
144cl
144cm
144cn
144co
144cp
144cq
144cr
144cs
144ct
144cu
144cv
144cw
144cx
144cy
144cz
144da
144db
144dc
144dd
144de
144df
144dg
144dh
144di
144dj
144dk
144dl
144dm
144dn
144do
144dp
144dq
144dr
144ds
144dt
144du
144dv
144dw
144dx
144dy
144dz
144ea
144eb
144ec
144ed
144ee
144ef
144eg
144eh
144ei
144ej
144ek
144el
144em
144en
144eo
144ep
144eq
144er
144es
144et
144eu
144ev
144ew
144ex
144ey
144ez
144fa
144fb
144fc
144fd
144fe
144ff
144fg
144fh
144fi
144fj
144fk
144fl
144fm
144fn
144fo
144fp
144fq
144fr
144fs
144ft
144fu
144fv
144fw
144fx
144fy
144fz
144ga
144gb
144gc
144gd
144ge
144gf
144gg
144gh
144gi
144gj
144gk
144gl
144gm
144gn
144go
144gp
144gq
144gr
144gs
144gt
144gu
144gv
144gw
144gx
144gy
144gz
144ha
144hb
144hc
144hd
144he
144hf
144hg
144hh
144hi
144hj
144hk
144hl
144hm
144hn
144ho
144hp
144hq
144hr
144hs
144ht
144hu
144hv
144hw
144hx
144hy
144hz
144ia
144ib
144ic
144id
144ie
144if
144ig
144ih
144ii
144ij
144ik
144il
144im
144in
144io
144ip
144iq
144ir
144is
144it
144iu
144iv
144iw
144ix
144iy
144iz
144ja
144jb
144jc
144jd
144je
144jf
144jg
144jh
144ji
144jj
144jk
144jl
144jm
144jn
144jo
144jp
144jq
144jr
144js
144jt
144ju
144jv
144jw
144jx
144jy
144jz
144ka
144kb
144kc
144kd
144ke
144kf
144kg
144kh
144ki
144kj
144kk
144kl
144km
144kn
144ko
144kp
144kq
144kr
144ks
144kt
144ku
144kv
144kw
144kx
144ky
144kz
144la
144lb
144lc
144ld
144le
144lf
144lg
144lh
144li
144lj
144lk
144ll
144lm
144ln
144lo
144lp
144lq
144lr
144ls
144lt
144lu
144lv
144lw
144lx
144ly
144lz
144ma
144mb
144mc
144md
144me
144mf
144mg
144mh
144mi
144mj
144mk
144ml
144mm
144mn
144mo
144mp
144mq
144mr
144ms
144mt
144mu
144mv
144mw
144mx
144my
144mz
144na
144nb
144nc
144nd
144ne
144nf
144ng
144nh
144ni
144nj
144nk
144nl
144nm
144nn
144no
144np
144nq
144nr
144ns
144nt
144nu
144nv
144nw
144nx
144ny
144nz
144oa
144ob
144oc
144od
144oe
144of
144og
144oh
144oi
144oj
144ok
144ol
144om
144on
144oo
144op
144oq
144or
144os
144ot
144ou
144ov
144ow
144ox
144oy
144oz
144pa
144pb
144pc
144pd
144pe
144pf
144pg
144ph
144pi
144pj
144pk
144pl
144pm
144pn
144po
144pp
144pq
144pr
144ps
144pt
144pu
144pv
144pw
144px
144py
144pz
144qa
144qb
144qc
144qd
144qe
144qf
144qg
144qh
144qi
144qj
144qk
144ql
144qm
144qn
144qo
144qp
144qq
144qr
144qs
144qt
144qu
144qv
144qw
144qx
144qy
144qz
144ra
144rb
144rc
144rd
144re
144rf
144rg
144rh
144ri
144rj
144rk
144rl
144rm
144rn
144ro
144rp
144rq
144rr
144rs
144rt
144ru
144rv
144rw
144rx
144ry
144rz
144sa
144sb
144sc
144sd
144se
144sf
144sg
144sh
144si
144sj
144sk
144sl
144sm
144sn
144so
144sp
144sq
144sr
144ss
144st
144su
144sv
144sw
144sx
144sy
144sz
144ta
144tb
144tc
144td
144te
144tf
144tg
144th
144ti
144tj
144tk
144tl
144tm
144tn
144to
144tp
144tq
144tr
144ts
144tt
144tu
144tv
144tw
144tx
144ty
144tz
144ua
144ub
144uc
144ud
144ue
144uf
144ug
144uh
144ui
144uj
144uk
144ul
144um
144un
144uo
144up
144uq
144ur
144us
144ut
144uu
144uv
144uw
144ux
144uy
144uz
144va
144vb
144vc
144vd
144ve
144vf
144vg
144vh
144vi
144vj
144vk
144vl
144vm
144vn
144vo
144vp
144vq
144vr
144vs
144vt
144vu
144vv
144vw
144vx
144vy
144vz
144wa
144wb
144wc
144wd
144we
144wf
144wg
144wh
144wi
144wj
144wk
144wl
144wm
144wn
144wo
144wp
144wq
144wr
144ws
144wt
144wu
144wv
144ww
144wx
144wy
144wz
144xa
144xb
144xc
144xd
144xe
144xf
144xg
144xh
144xi
144xj
144xk
144xl
144xm
144xn
144xo
144xp
144xq
144xr
144xs
144xt
144xu
144xv
144xw
144xx
144xy
144xz
144ya
144yb
144yc
144yd
144ye
144yf
144yg
144yh
144yi
144yj
144yk
144yl
144ym
144yn
144yo
144yp
144yq
144yr
144ys
144yt
144yu
144yv
144yw
144yx
144yy
144yz
144za
144zb
144zc
144zd
144ze
144zf
144zg
144zh
144zi
144zj
144zk
144zl
144zm
144zn
144zo
144zp
144zq
144zr
144zs
144zt
144zu
144zv
144zw
144zx
144zy
144zz
146
146a
146b
146c
146d
146e
146f
146g
146h
146i
146j
146k
146l
146m
146n
146o
146p
146q
146r
146s
146t
146u
146v
146w
146x
146y
146z
146aa
146ab
146ac
146ad
146ae
146af
146ag
146ah
146ai
146aj
146ak
146al
146am
146an
146ao
146ap
146aq
146ar
146as
146at
146au
146av
146aw
146ax
146ay
146az
146ba
146bb
146bc
146bd
146be
146bf
146bg
146bh
146bi
146bj
146bk
146bl
146bm
146bn
146bo
146bp
146bq
146br
146bs
146bt
146bu
146bv
146bw
146bx
146by
146bz
146ca
146cb
146cc
146cd
146ce
146cf
146cg
146ch
146ci
146cj
146ck
146cl
146cm
146cn
146co
146cp
146cq
146cr
146cs
146ct
146cu
146cv
146cw
146cx
146cy
146cz
146da
146db
146dc
146dd
146de
146df
146dg
146dh
146di
146dj
146dk
146dl
146dm
146dn
146do
146dp
146dq
146dr
146ds
146dt
146du
146dv
146dw
146dx
146dy
146dz
146ea
146eb
146ec
146ed
146ee
146ef
146eg
146eh
146ei
146ej
146ek
146el
146em
146en
146eo
146ep
146eq
146er
146es
146et
146eu
146ev
146ew
146ex
146ey
146ez
146fa
146fb
146fc
146fd
146fe
146ff
146fg
146fh
146fi
146fj
146fk
146fl
146fm
146fn
146fo
146fp
146fq
146fr
146fs
146ft
146fu
146fv
146fw
146fx
146fy
146fz
146ga
146gb
146gc
146gd
146ge
146gf
146gg
146gh
146gi
146gj
146gk
146gl
146gm
146gn
146go
146gp
146gq
146gr
146gs
146gt
146gu
146gv
146gw
146gx
146gy
146gz
146ha
146hb
146hc
146hd
146he
146hf
146hg
146hh
146hi
146hj
146hk
146hl
146hm
146hn
146ho
146hp
146hq
146hr
146hs
146ht
146hu
146hv
146hw
146hx
146hy
146hz
146ia
146ib
146ic
146id
146ie
146if
146ig
146ih
146ii
146ij
146ik
146il
146im
146in
146io
146ip
146iq
146ir
146is
146it
146iu
146iv
146iw
146ix
146iy
146iz
146ja
146jb
146jc
146jd
146je
146jf
146jg
146jh
146ji
146jj
146jk
146jl
146jm
146jn
146jo
146jp
146jq
146jr
146js
146jt
146ju
146jv
146jw
146jx
146jy
146jz
146ka
146kb
146kc
146kd
146ke
146kf
146kg
146kh
146ki
146kj
146kk
146kl
146km
146kn
146ko
146kp
146kq
146kr
146ks
146kt
146ku
146kv
146kw
146kx
146ky
146kz
146la
146lb
146lc
146ld
146le
146lf
146lg
146lh
146li
146lj
146lk
146ll
146lm
146ln
146lo
146lp
146lq
146lr
146ls
146lt
146lu
146lv
146lw
146lx
146ly
146lz
146ma
146mb
146mc
146md
146me
146mf
146mg
146mh
146mi
146mj
146mk
146ml
146mm
146mn
146mo
146mp
146mq
146mr
146ms
146mt
146mu
146mv
146mw
146mx
146my
146mz
146na
146nb
146nc
146nd
146ne
146nf
146ng
146nh
146ni
146nj
146nk
146nl
146nm
146nn
146no
146np
146nq
146nr
146ns
146nt
146nu
146nv
146nw
146nx
146ny
146nz
146oa
146ob
146oc
146od
146oe
146of
146og
146oh
146oi
146oj
146ok
146ol
146om
146on
146oo
146op
146oq
146or
146os
146ot
146ou
146ov
146ow
146ox
146oy
146oz
146pa
146pb
146pc
146pd
146pe
146pf
146pg
146ph
146pi
146pj
146pk
146pl
146pm
146pn
146po
146pp
146pq
146pr
146ps
146pt
146pu
146pv
146pw
146px
146py
146pz
146qa
146qb
146qc
146qd
146qe
146qf
146qg
146qh
146qi
146qj
146qk
146ql
146qm
146qn
146qo
146qp
146qq
146qr
146qs
146qt
146qu
146qv
146qw
146qx
146qy
146qz
146ra
146rb
146rc
146rd
146re
146rf
146rg
146rh
146ri
146rj
146rk
146rl
146rm
146rn
146ro
146rp
146rq
146rr
146rs
146rt
146ru
146rv
146rw
146rx
146ry
146rz
146sa
146sb
146sc
146sd
146se
146sf
146sg
146sh
146si
146sj
146sk
146sl
146sm
146sn
146so
146sp
146sq
146sr
146ss
146st
146su
146sv
146sw
146sx
146sy
146sz
146ta
146tb
146tc
146td
146te
146tf
146tg
146th
146ti
146tj
146tk
146tl
146tm
146tn
146to
146tp
146tq
146tr
146ts
146tt
146tu
146tv
146tw
146tx
146ty
146tz
146ua
146ub
146uc
146ud
146ue
146uf
146ug
146uh
146ui
146uj
146uk
146ul
146um
146un
146uo
146up
146uq
146ur
146us
146ut
146uu
146uv
146uw
146ux
146uy
146uz
146va
146vb
146vc
146vd
146ve
146vf
146vg
146vh
146vi
146vj
146vk
146vl
146vm
146vn
146vo
146vp
146vq
146vr
146vs
146vt
146vu
146vv
146vw
146vx
146vy
146vz
146wa
146wb
146wc
146wd
146we
146wf
146wg
146wh
146wi
146wj
146wk
146wl
146wm
146wn
146wo
146wp
146wq
146wr
146ws
146wt
146wu
146wv
146ww
146wx
146wy
146wz
146xa
146xb
146xc
146xd
146xe
146xf
146xg
146xh
146xi
146xj
146xk
146xl
146xm
146xn
146xo
146xp
146xq
146xr
146xs
146xt
146xu
146xv
146xw
146xx
146xy
146xz
146ya
146yb
146yc
146yd
146ye
146yf
146yg
146yh
146yi
146yj
146yk
146yl
146ym
146yn
146yo
146yp
146yq
146yr
146ys
146yt
146yu
146yv
146yw
146yx
146yy
146yz
146za
146zb
146zc
146zd
146ze
146zf
146zg
146zh
146zi
146zj
146zk
146zl
146zm
146zn
146zo
146zp
146zq
146zr
146zs
146zt
146zu
146zv
146zw
146zx
146zy
146zz
148
148a
148b
148c
148d
148e
148f
148g
148h
148i
148j
148k
148l
148m
148n
148o
148p
148q
148r
148s
148t
148u
148v
148w
148x
148y
148z
148aa
148ab
148ac
148ad
148ae
148af
148ag
148ah
148ai
148aj
148ak
148al
148am
148an
148ao
148ap
148aq
148ar
148as
148at
148au
148av
148aw
148ax
148ay
148az
148ba
148bb
148bc
148bd
148be
148bf
148bg
148bh
148bi
148bj
148bk
148bl
148bm
148bn
148bo
148bp
148bq
148br
148bs
148bt
148bu
148bv
148bw
148bx
148by
148bz
148ca
148cb
148cc
148cd
148ce
148cf
148cg
148ch
148ci
148cj
148ck
148cl
148cm
148cn
148co
148cp
148cq
148cr
148cs
148ct
148cu
148cv
148cw
148cx
148cy
148cz
148da
148db
148dc
148dd
148de
148df
148dg
148dh
148di
148dj
148dk
148dl
148dm
148dn
148do
148dp
148dq
148dr
148ds
148dt
148du
148dv
148dw
148dx
148dy
148dz
148ea
148eb
148ec
148ed
148ee
148ef
148eg
148eh
148ei
148ej
148ek
148el
148em
148en
148eo
148ep
148eq
148er
148es
148et
148eu
148ev
148ew
148ex
148ey
148ez
148fa
148fb
148fc
148fd
148fe
148ff
148fg
148fh
148fi
148fj
148fk
148fl
148fm
148fn
148fo
148fp
148fq
148fr
148fs
148ft
148fu
148fv
148fw
148fx
148fy
148fz
148ga
148gb
148gc
148gd
148ge
148gf
148gg
148gh
148gi
148gj
148gk
148gl
148gm
148gn
148go
148gp
148gq
148gr
148gs
148gt
148gu
148gv
148gw
148gx
148gy
148gz
148ha
148hb
148hc
148hd
148he
148hf
148hg
148hh
148hi
148hj
148hk
148hl
148hm
148hn
148ho
148hp
148hq
148hr
148hs
148ht
148hu
148hv
148hw
148hx
148hy
148hz
148ia
148ib
148ic
148id
148ie
148if
148ig
148ih
148ii
148ij
148ik
148il
148im
148in
148io
148ip
148iq
148ir
148is
148it
148iu
148iv
148iw
148ix
148iy
148iz
148ja
148jb
148jc
148jd
148je
148jf
148jg
148jh
148ji
148jj
148jk
148jl
148jm
148jn
148jo
148jp
148jq
148jr
148js
148jt
148ju
148jv
148jw
148jx
148jy
148jz
148ka
148kb
148kc
148kd
148ke
148kf
148kg
148kh
148ki
148kj
148kk
148kl
148km
148kn
148ko
148kp
148kq
148kr
148ks
148kt
148ku
148kv
148kw
148kx
148ky
148kz
148la
148lb
148lc
148ld
148le
148lf
148lg
148lh
148li
148lj
148lk
148ll
148lm
148ln
148lo
148lp
148lq
148lr
148ls
148lt
148lu
148lv
148lw
148lx
148ly
148lz
148ma
148mb
148mc
148md
148me
148mf
148mg
148mh
148mi
148mj
148mk
148ml
148mm
148mn
148mo
148mp
148mq
148mr
148ms
148mt
148mu
148mv
148mw
148mx
148my
148mz
148na
148nb
148nc
148nd
148ne
148nf
148ng
148nh
148ni
148nj
148nk
148nl
148nm
148nn
148no
148np
148nq
148nr
148ns
148nt
148nu
148nv
148nw
148nx
148ny
148nz
148oa
148ob
148oc
148od
148oe
148of
148og
148oh
148oi
148oj
148ok
148ol
148om
148on
148oo
148op
148oq
148or
148os
148ot
148ou
148ov
148ow
148ox
148oy
148oz
148pa
148pb
148pc
148pd
148pe
148pf
148pg
148ph
148pi
148pj
148pk
148pl
148pm
148pn
148po
148pp
148pq
148pr
148ps
148pt
148pu
148pv
148pw
148px
148py
148pz
148qa
148qb
148qc
148qd
148qe
148qf
148qg
148qh
148qi
148qj
148qk
148ql
148qm
148qn
148qo
148qp
148qq
148qr
148qs
148qt
148qu
148qv
148qw
148qx
148qy
148qz
148ra
148rb
148rc
148rd
148re
148rf
148rg
148rh
148ri
148rj
148rk
148rl
148rm
148rn
148ro
148rp
148rq
148rr
148rs
148rt
148ru
148rv
148rw
148rx
148ry
148rz
148sa
148sb
148sc
148sd
148se
148sf
148sg
148sh
148si
148sj
148sk
148sl
148sm
148sn
148so
148sp
148sq
148sr
148ss
148st
148su
148sv
148sw
148sx
148sy
148sz
148ta
148tb
148tc
148td
148te
148tf
148tg
148th
148ti
148tj
148tk
148tl
148tm
148tn
148to
148tp
148tq
148tr
148ts
148tt
148tu
148tv
148tw
148tx
148ty
148tz
148ua
148ub
148uc
148ud
148ue
148uf
148ug
148uh
148ui
148uj
148uk
148ul
148um
148un
148uo
148up
148uq
148ur
148us
148ut
148uu
148uv
148uw
148ux
148uy
148uz
148va
148vb
148vc
148vd
148ve
148vf
148vg
148vh
148vi
148vj
148vk
148vl
148vm
148vn
148vo
148vp
148vq
148vr
148vs
148vt

MOUNTING AND FRAMING SYSTEM AND APPARATUS

BACKGROUND OF THE INVENTION

1. Field of the Invention

The invention relates to an apparatus and a system for mounting and framing graphic items, such as prints, photographs, paintings or the like, with or without mattes.

2. Description of Related Art

The prior art includes a variety of structures or methods for displaying graphic items, such as prints or photographs, wherein the items are adhesively secured to such as a matte or to a transparent mounting member or wherein several displayed items are held between transparent layers held together by a conventional picture frame.

U.S. Pat. No. 2,556,798 discloses a 3-dimensional exhibit in which multiple layers of transparent material are each provided with an image, with the layers being held in a transparent box filled with a fluid or transparent adhesive.

In U.S. Pat. No. 3,314,180, a 3-D picture is held within a deep frame. The picture is constructed of multiple layers mounted on transparent sheets separated by foam and a motor is used to repetitively compress the foam to drive the layers towards and away from each other. Herein, the transparent layers do not trap or squeeze the pictures to hold them in place.

U.S. Pat. No. 4,794,714 discloses a conventional picture frame unit for holding and displaying multiple items.

U.S. Pat. No. 5,371,963 shows and describes a display apparatus for holding multiple small items and protecting them against UV radiation.

In U.S. Pat. No. 5,383,293, a front protective layer of transparent plastic or glass and an inner transparent film having material printed thereon are held at their edges by a picture frame.

U.S. Pat. No. 6,640,476 discloses a single, illuminated, transparent layer for supporting a drawing, with the single transparent layer being located above an opaque layer.

The prior art fails to teach a mounting and framing system and apparatus wherein displayed items are trapped between multiple layers of transparent material with the displayed items being held in place by a clamping force applied to the layers of transparent material by pressure means.

SUMMARY OF THE INVENTION

A primary object of the invention is to display graphic material such as prints, photographs, paintings, mattes, or the like between multiple layers of transparent material such as plates of glass, or transparent acrylic plating identified by the trademark PLEXIGLAS, or other clear plastic to impart a sense of depth thereto, with the displayed material being held securely in place by clamping means which applies a clamping force to the layers of transparent material.

As a salient feature of the invention, clamping or compressive force is applied to the multiple transparent layers by pairs of pressure members in the form of slat-like bars positioned to bear against the outermost transparent layers.

Another object of the invention is to provide a mounting and framing system and apparatus for material to be displayed wherein the color and texture of the surface behind the display apparatus is visible through the multiple transparent layers which trap the displayed material.

In one form of the invention, displayed material is held in place between layers of transparent material by pressure applied to the front and rear transparent layers by pairs of front and rear clamping bars, which may be disposed in vertical or horizontal orientation and which may be fabricated from wood or any suitable rigid material.

In a further embodiment of the invention, multiple pairs of clamping bars provide a compressive force to multiple layers of transparent material which trap the displayed material therebetween.

In another form of the invention, decorative members which have no mechanical function, but add an aesthetic feature, are disposed at a 90 degree orientation to the clamping bars which compress the displayed material between layers of transparent material.

In all embodiments of the invention, suitable mechanical fasteners, such as bolts and nuts or the like, draw the clamping bars toward one another, clamping the transparent layers together, thus capturing the prints, photographs, paintings, mattes, or the like in their respective layers, with the fasteners extending either through or above or below the transparent layers.

As a further feature of the invention, spacers are positioned between the clamping bars to prevent cracking of the transparent layers due to the pressure exerted by the clamping bars if the transparent layers are glass plates and to ensure proper compression in general and particularly if the transparent layers are PLEXIGLAS plates.

The numbers of transparent layers and combinations of displayed material may be increased or decreased as desired.

The total length of the framing unit can be increased by adding spaced "bays" created by placing pairs of clamping bars along a length of transparent layers disposed in tandem.

BRIEF DESCRIPTION OF THE DRAWINGS

FIG. 2 is an exploded plan view of the mounting and framing apparatus of FIG. 1;

FIG. 4 is an enlarged, fragmentary, front elevational view of one corner portion of mounting and framing apparatus embodying a first modified form of the invention;

FIG. 5 is an exploded plan view of the modified mounting and framing apparatus of FIG. 4;

FIG. 7 is an exploded plan view of the modified mounting and framing apparatus of FIG. 6;

DETAILED DESCRIPTION OF THE PREFERRED EMBODIMENTS

Figure 1:
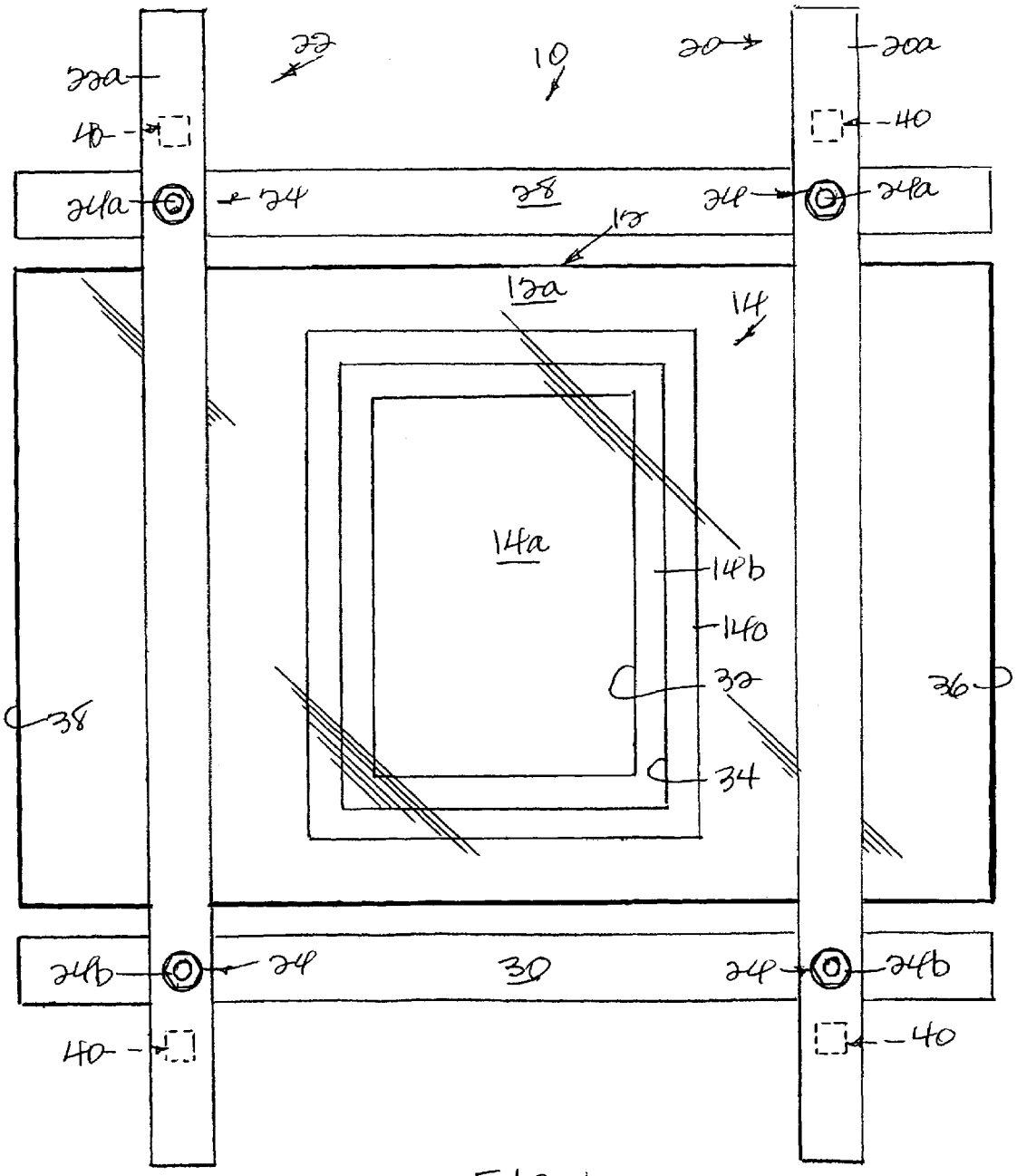
FIG. 1 is a front elevational view of mounting and framing apparatus embodying a preferred form of the invention.
Figure 3:
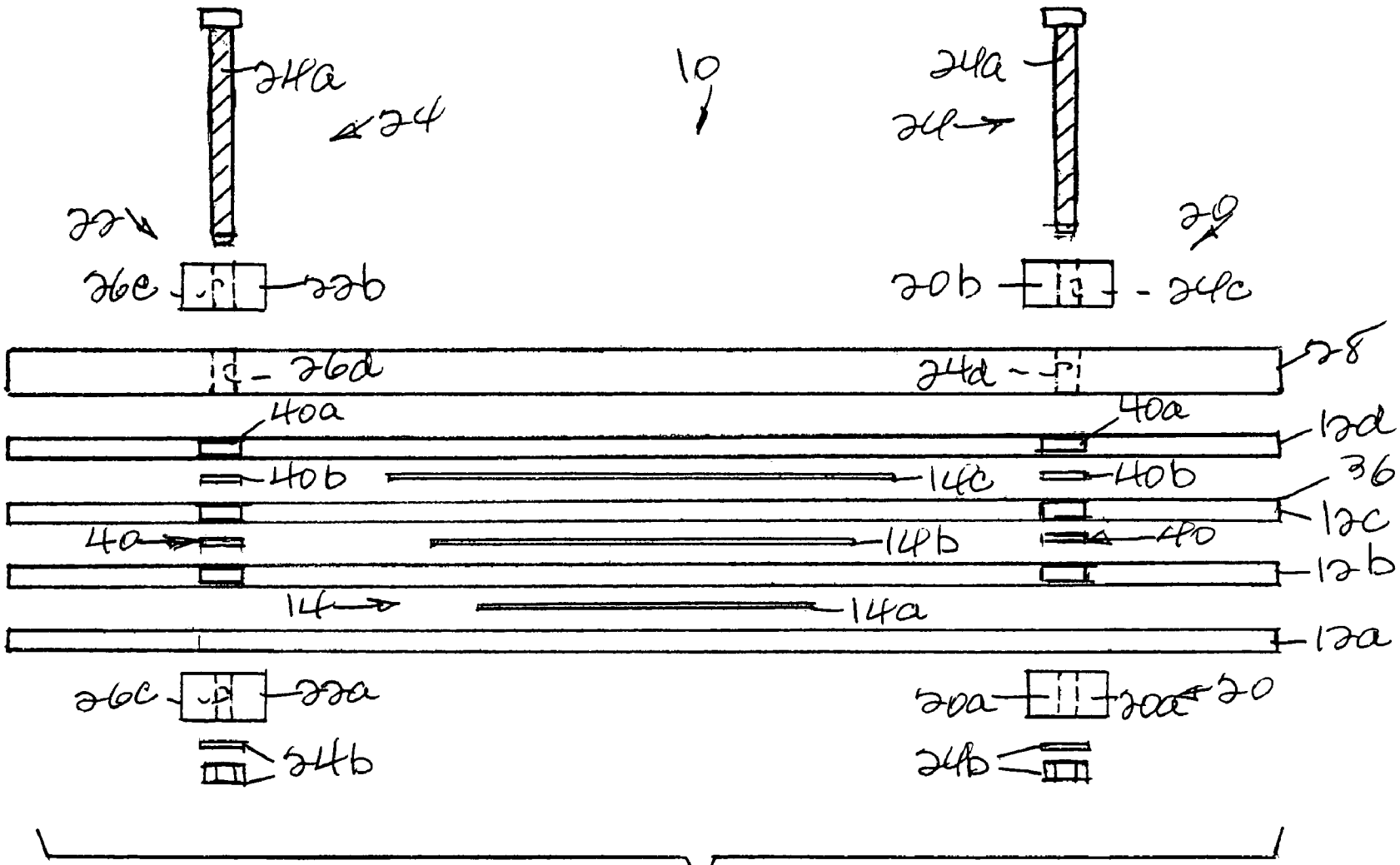
FIG. 3 is a front elevational view of the mounting and framing apparatus of FIG. 1 suspended from a supporting surface.
Figure 3:
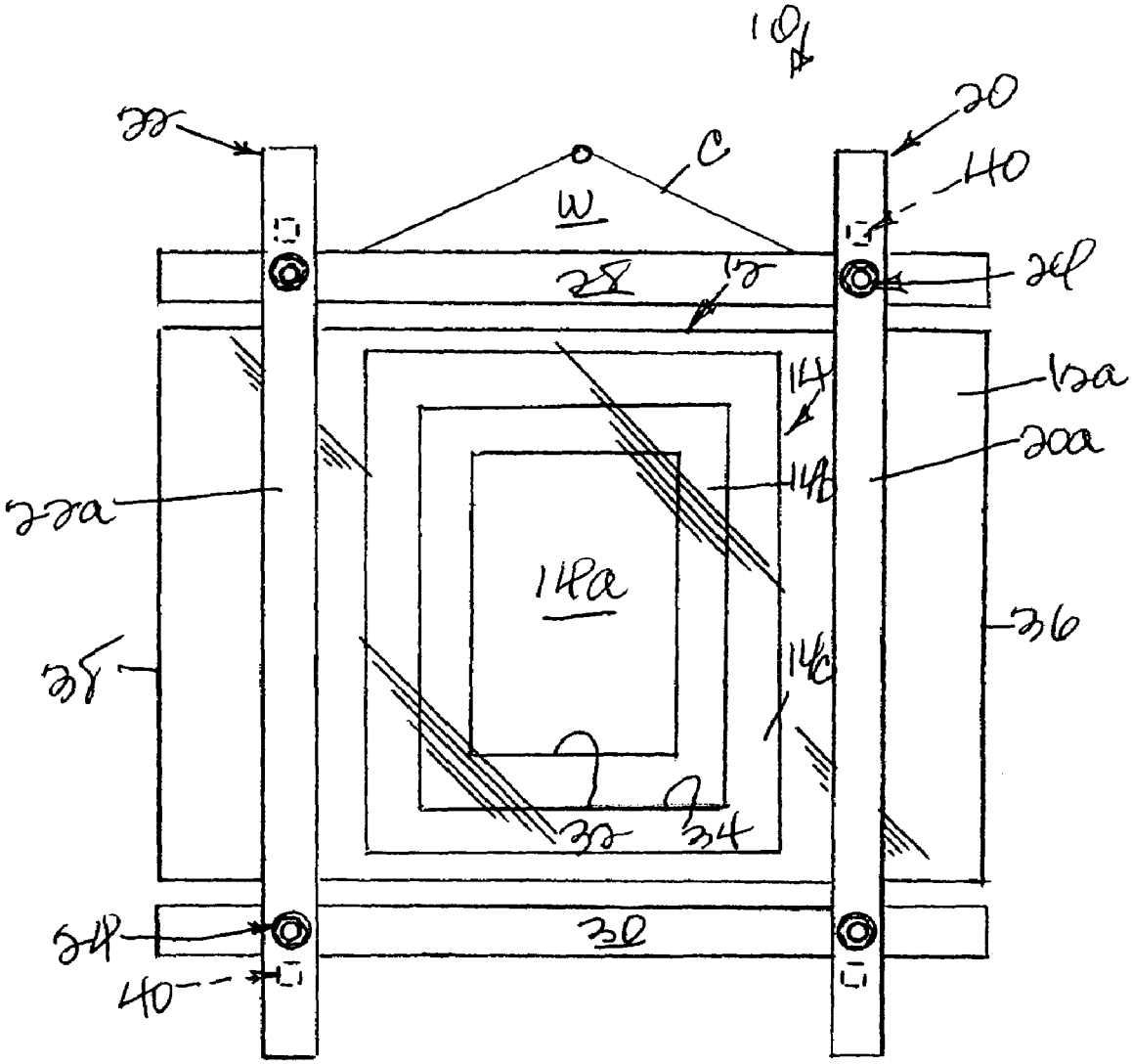

Referring first to FIGS. 1-3, mounting and framing apparatus embodying a preferred form of the invention is generally indicated by 10 and includes layers of flat, generally rectangular, transparent, glass, PLEXIGLAS, or other clear plastic plates generally indicated by 12 and including a forward plate l2*a*, first and second central plates 12*b* and 12*c*, respectively, and a rear plate 12*d*.

Display material, generally indicated by 14, comprises such as prints, photographs, paintings, graphics 14*a*, or the like, and first and second mattes 14*b* and 14*c* respectively.

The prints or other graphic material 14*a* of display material 14 are positioned between forward plate 12*a* and first central plate 12*b* of transparent plates 12; first matte 14*b* is positioned between first and second plates 12*b* and 12*c*, respectively so as to outline display material 14*a*; and second matte 14*c* is positioned between second central plate 12*c* and rear plate 12*d* so as to outline first matte 14*b*.

Spaced, parallel, first and second pairs of damping means, generally indicated by 20 and 22 respectively, fabricated from wood, thermoplastic or other rigid material, are disposed in bearing relation to transparent plates 12.

Fastening means, generally indicated by 24, are associated with the first and second pairs 20 and 22 respectively of the clamping means.

Spaced, parallel, upper and lower decorative members 28 and 30 respectively, fabricated from wood, thermoplastic or other rigid material, are mounted by fastening means 24 to clamping means 20 and 22 and are preferably disposed at a 90 degree orientation relative to the clamping means.

While clamping means 20 and 22 are shown in the drawings as being vertically disposed, they may be horizontally disposed.

Similarly, while decorative members 28 and 30 are shown in the drawings as being horizontally disposed, they may be vertically disposed.

A central opening 32 in first matte 14*b* and a central rectangular opening 34 in second matte 14*c* give the illusion of surrounding display material 14*a*.

The first pair of clamping means 20 comprises a forward clamping bar 20*a* positioned forwardly of forward plate 12*a* and a rear clamping bar 20*b* positioned rearwardly of rear plate 12*d*, with both damping bars 20*a* and 20*b* being positioned adjacent a first side edge 36 of transparent plates 12.

The second pair of clamping means 22 comprises a forward clamping bar 22*a* positioned forwardly of forward plate 12*a* and a rear clamping bar 22*b* positioned rearwardly of rear plate 12*d*, with both clamping bars 22*a* and 22*b* being positioned adjacent a second side edge 38 of plates 12.

Fastening means 24 comprises mechanical fasteners such as bolts 24*a* or the like having nuts and washers 24*b* sleeved and threaded thereon, with a pair of such bolts extending through provided openings 24*c* in clamping bars 20*a* and 20*b* of the first pair of clamping means 20 and through provided openings 24*d* in upper and lower decorative members 28 and 30 respectively.

A pair of bolts 24*a* of fastening means 24 also extends through provided openings 26*c* in clamping bars 22*a* and 22*b* of the second pair of clamping means 22 and through provided openings 26*d* in upper and lower decorative members 28 and 30 respectively.

Fastening means 24 may alternatively be positioned so as to pass through provided openings, not shown, in plates 12, in addition to passing through the pairs of clamping means 20 and 22.

In all instances, the fastening means 24 draw the forward and rear clamping bars of each clamping bar pair 20 and 22 toward one another thereby clamping the transparent plates 12 together, thus capturing the display material 14 between the plates.

As shown in FIG. 3, mounting and framing apparatus 10 may be suspended from a wall W or other supporting surface by such as a wire, cord or chain C fixed to the rear surfaces of clamping means 20 and 22.

Various combinations of transparent plates, compression means, decorative means and fastening means may be employed to allow multiple images to be displayed simultaneously, and to give the entire assembly a sense of depth, while the material being displayed is captured securely between the transparent plates.

Figure 1A:
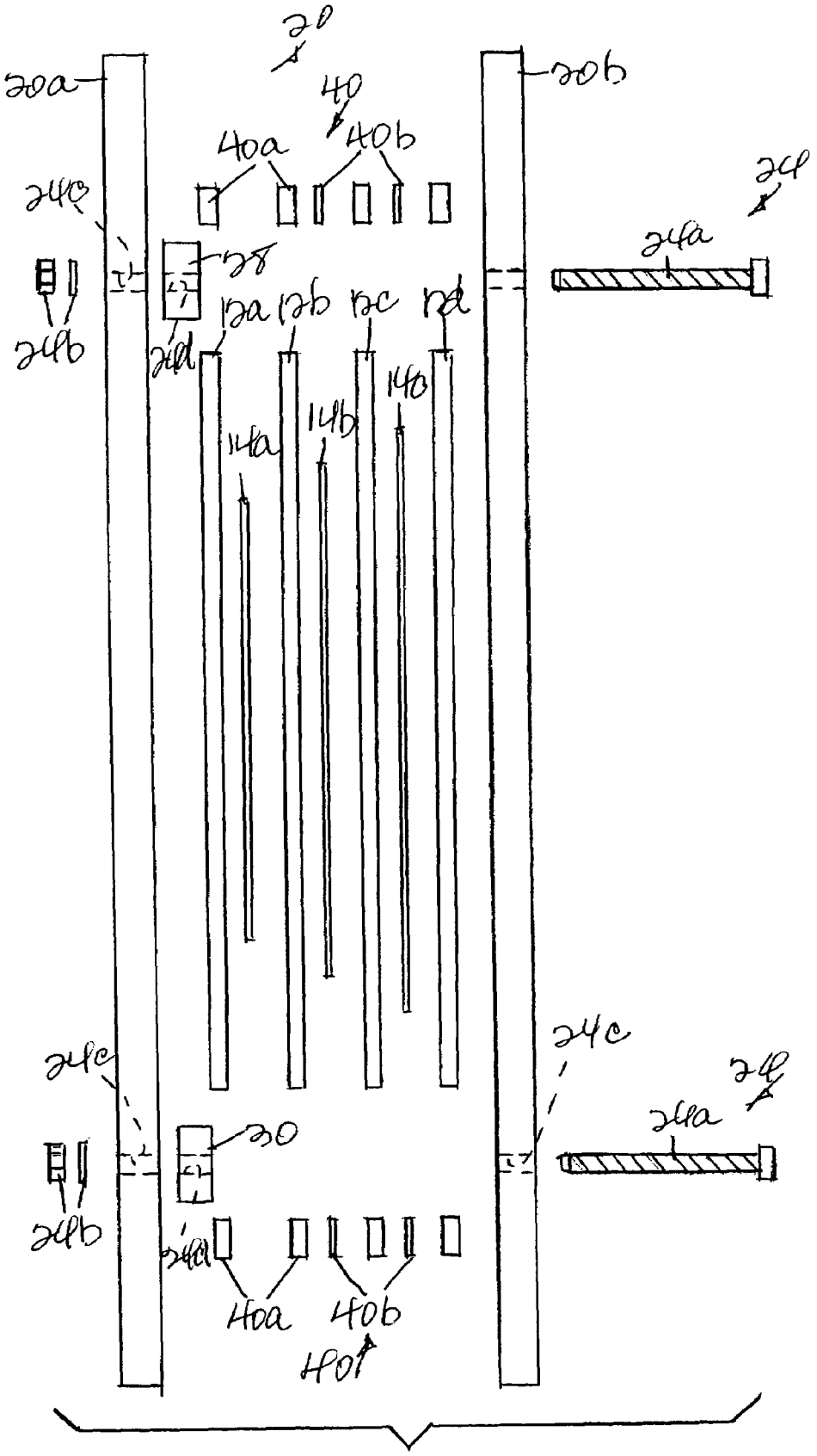
FIG. 1*a* is an exploded side elevational view of the mounting and framing apparatus of FIG. 1.

As best seen in FIG. 1*a* and FIG. 2, spacers, generally indicated by 40, are provided between forward and rear clamping bars 20*a* and 20*b* respectively of the first pair of clamping means 20 and between forward and rear clamping bars 22*a* and 22*b* of the second pair of clamping means 22 and comprise generally rectangular blocks 40*a* and shims 40*b* formed from any suitably rigid material and positioned immediately above and below fastening means 24.

Blocks 40*a* and shims 40*b* of spacers 40 are of approximately the same thickness as that of transparent plates 12 and of first and second mattes 14*b* and 14*c*, respectively, so that when the clamping bars of clamping means 20 and 22 are drawn together by fastening means 24, the spacers substantially bridge the gap between the forward and rear damping bars of the damping means whereby excessive clamping force which might crack or distort the transparent plates is precluded.

For added aesthetic appeal the clamping bars 20 and 22, the fastening means 24, and the decorative members 28 and 30 of the embodiment of FIGS. 1-3 may be replaced by more ornate members, as described and illustrated herefollowing, in several modified forms of the invention.

Mounting and framing apparatus 100 embodying a first modified form of the invention is shown in FIGS. 4 and 5, which comprise enlarged, fragmentary showings of an upper corner portion of the mounting and framing apparatus which includes a stacked arrangement of flat, generally rectangular, transparent, glass, PLEXI-GLAS or clear plastic plates generally indicated by 112 and including a forward plate 112*a* and a rear plate 112*b*.

Mounting and framing apparatus 100 also includes display material 114 such as prints, photographs, paintings, graphics, or the like disposed between plates 112*a* and 112*b*; a first pair of vertically extending forward and rear rigid clamping means 120*a* and 120*b* respectively; an upper pair of horizontally extending front and rear decorative members 128*a* and 128*b* respectively; and fastening means 124 comprising a bolt 124*a* which extends through provided openings 124*c* in clamping means 120*a* and 120*b* and provided openings 124*d* in decorative members 128*a* and 128*b* and has a nut 124*b* threaded thereon.

Display material 114 is captured between forward and rear transparent plates 112*a* and 112*b* respectively while the transparent plates are captured between forward and rear clamping means 120*a* and 120*b* respectively, with tightening of fastening means 124 causing the clamping means to exert a compressive force on the transparent plates.

Spacers, generally indicated by 140, which comprise substantially rectangular blocks 140*a* formed from any suitably rigid material, are provided adjacent fastening means 124 and are positioned between forward and rear clamping means 120*a* and 120*b* respectively and are of the same thickness as that of transparent plates 112*a* and 112*b* so as to substantially bridge the gap between the clamping means whereby excessive force which might crack or distort the transparent plates is precluded.

Forward and rear clamping means 120*a* and 120*b* respectively, are rounded or contoured at one of their side edges and at their ends as at 120*c*, while the adjacent ends of front and rear decorative members 128*a* and 128*b* respectively are curved in opposite directions as at 128*c* to enhance their appearance.

It will be understood that mounting and framing apparatus 100 will include an additional pair of clamping members, not shown, in spaced parallelism to clamping members 120*a* and 120*b* and an additional pair of decorative members, not shown, in spaced parallelism to decorative members 128*a* and 128*b*, along with additional fastening means and spacers, not shown, similar to fastening means 124 and spacers 140, to provide an arrangement of components similar to that shown in FIGS. 1-3.

Figure 6:
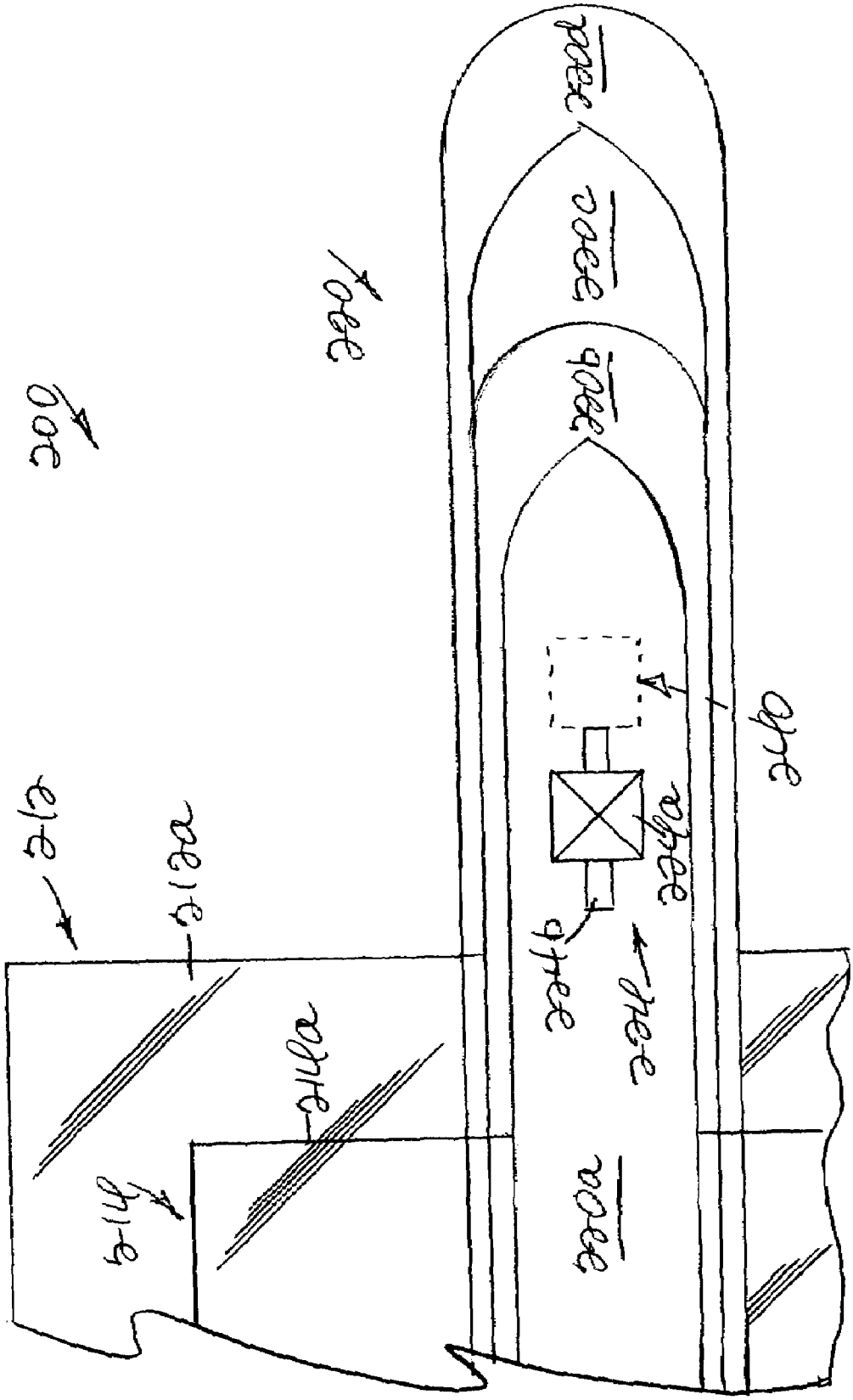
FIG. 6 is an enlarged, fragmentary, front elevational view of one corner portion of mounting and framing apparatus embodying a second modified form of the invention.
Figure 17:
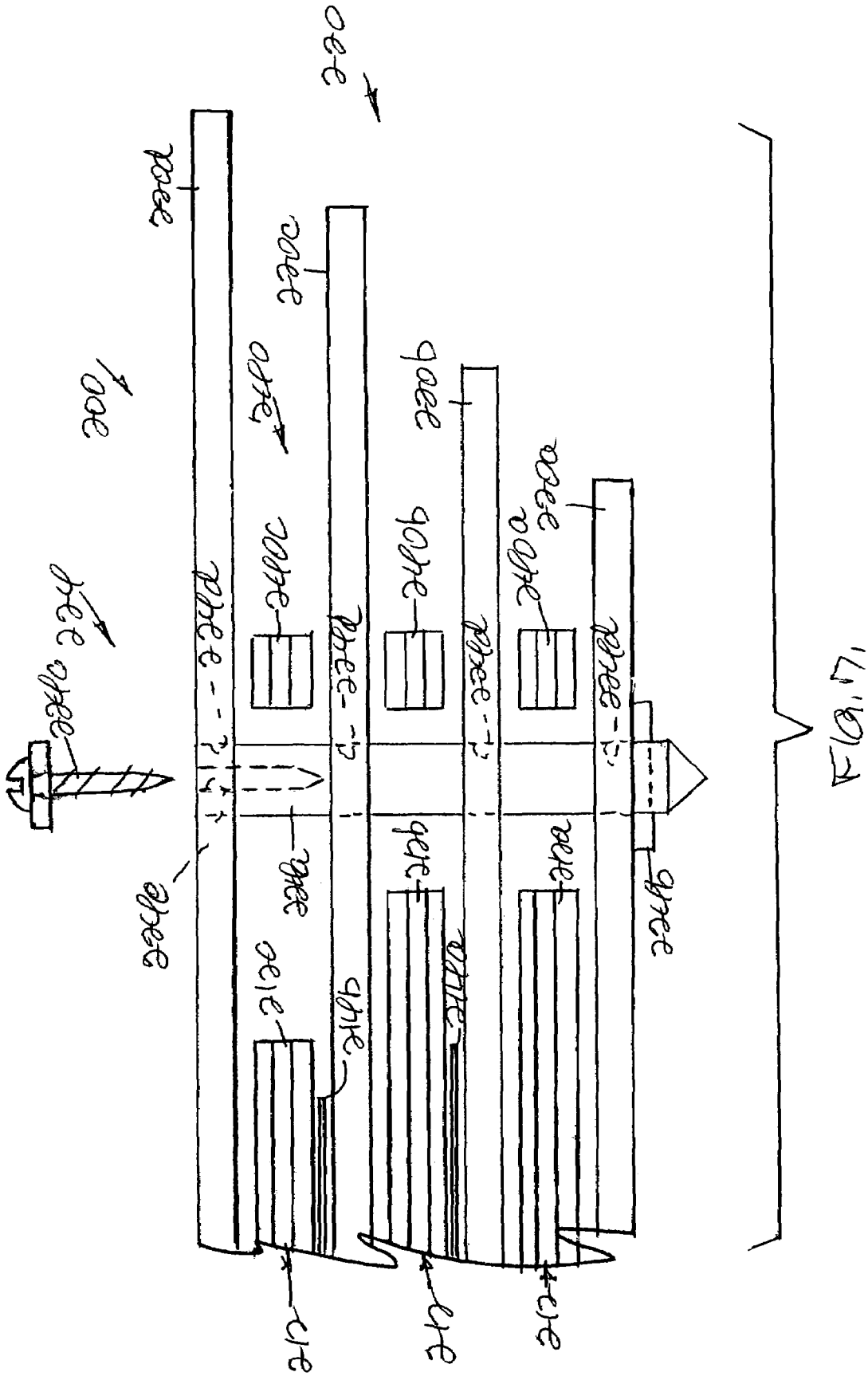

A second modified form of mounting and framing apparatus 200 embodying the invention is shown in FIGS. 6 and 7, which comprise enlarged, fragmentary showings of an upper corner portion of the mounting and framing apparatus and which includes multiple, stacked, flat, generally rectangular, transparent, glass, PLEXIGLAS, or other clear plastic plates generally indicated by 212 namely, a forward stack 212*a*, a central stack 212*b* and a rear stack 212*c*, with each stack comprising several transparent plates disposed in face to face relationship.

Mounting and framing apparatus 200 includes display material 214 such as prints, photographs, paintings, graphics, or the like, disposed between the stacks of transparent plates 212 and comprising forward display material 214*a* and rear display material 214*b*.

Mounting and framing apparatus 200 further includes upper, rigid clamping means 220 which is disposed adjacent the upper longitudinal edges of transparent plates 212 and display material 214 and extends horizontally across the stacks of transparent plates 212 and display material 214.

Upper clamping means 220 comprises a forward clamping bar 220*a*, first and second central clamping bars 220*b* and 220*c* respectively, and a rear clamping bar 220*d*.

Lower, rigid clamping means, not shown, which is identical to upper damping means 220 is positioned in spaced parallelism to the upper damping means and is disposed adjacent the lower longitudinal edges of transparent plates 212 and display material 214 and extends horizontally thereacross.

Forward clamping bar 220*a* and first central clamping bar 220*b* capture forward stack 212*a* of transparent plates 212 therebetween.

First central clamping bar 220*b* and second central clamping bar 220*c* capture forward display material 214*a* and central stack 212*b* of transparent plates 212 therebetween.

Second central clamping bar 220*c* and rear clamping bar 220*d* capture rear display material 214*b* and rear stack 212*c* of transparent plates 212 therebetween.

Clamping bars 220*a*, 220*b*, 220*c* and 220*d* are interconnected by fastening means, generally indicated by 224, which includes a peg 224*a*, a pin 224*b* and a screw and washer 224*c*, with peg 224*a* extending through aligned openings 224*d* provided in each of the clamping bars adjacent their outer free ends.

Pin 224*b* is disposed adjacent the outer, forward end of peg 224*a* and extends transversely through and outwardly from each side edge of peg 224*a* so as to embrace the outer, forward face of forward clamping bar 220*a*.

Screw 224*c* is engageable in a threaded opening 224*e* provided in the inner, rear end of peg 224*a*, whereby tightening of the screw draws the peg rearwardly causing pin 224*b* to exert an rearward force on forward clamping bar 220*a* drawing all of clamping bars 220*a*, 220*b*, 220*c* and 220*d* toward one another and into tight, compressing engagement with the stacks of transparent plates 212 and the display 214 material captured therebetween.

Spacers, generally indicated by 240, in the form of stacked, substantially rectangular blocks, are positioned immediately adjacent peg 224*a* of fastening means 224 and comprise a forward spacer block 240*a* positioned between forward clamping bar 220*a* and first, central clamping bar 220*b*, a central spacer block 240*b* positioned between first, central clamping bar 220*b* and second, central clamping bar 220*c*, and a rear spacer block 240*c* positioned between second, central damping bar 220*c* and rear clamping bar 220*d*.

Spacer blocks 240, which are of the same general thickness as that of the stacks of transparent plates 212, substantially bridge the gaps between the clamping bars 220 whereby excessive clamping force which might crack or distort the transparent plates is precluded.

It will be understood that modified mounting and framing apparatus 200 will include spaced, parallel, upper and lower, rigid damping means 220, with each clamping means having spacer blocks 240 disposed between the clamping bars thereof and with fastening means 224 extending through the clamping bars adjacent each opposite end thereof.

Figure 8:
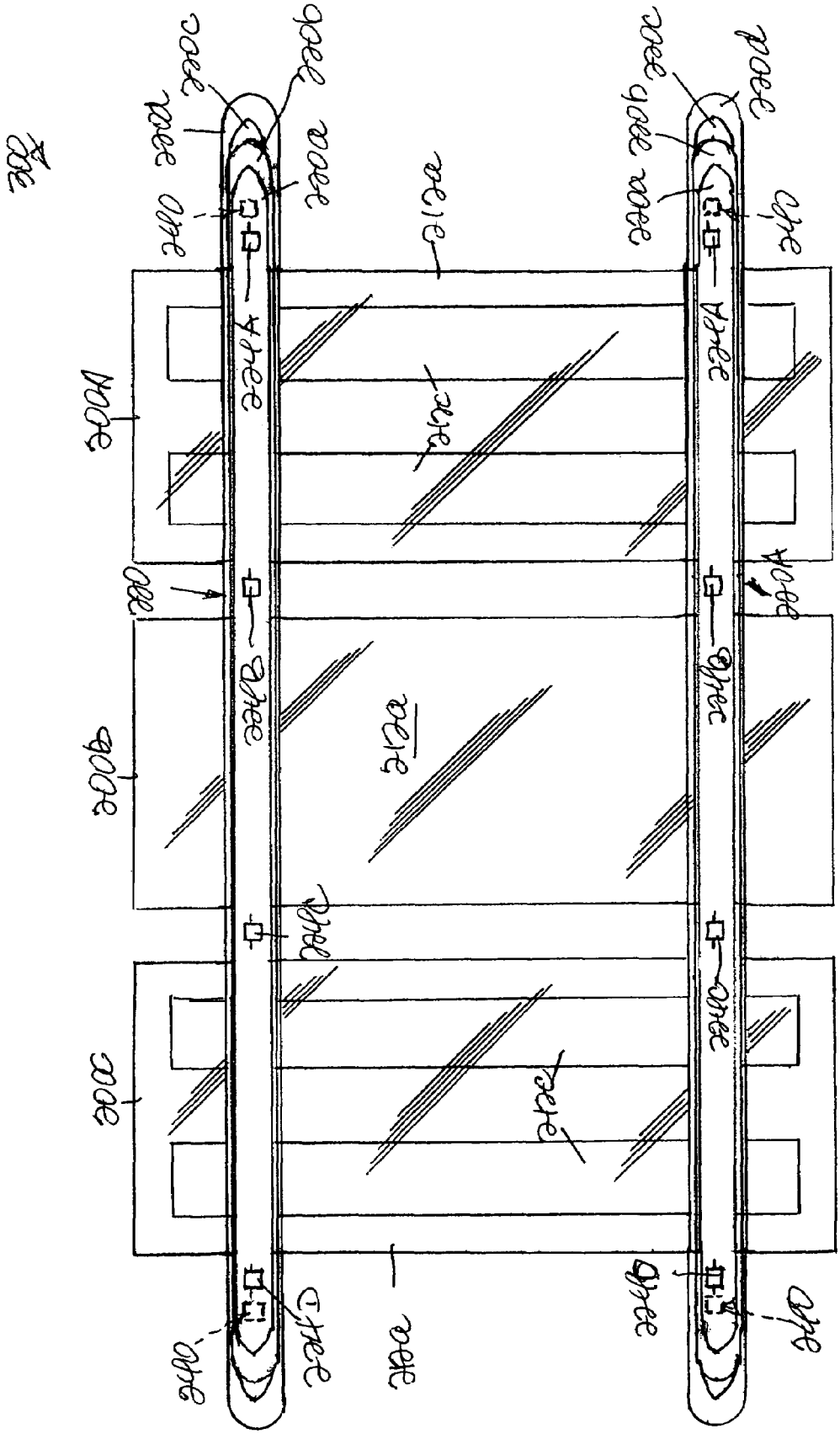
FIG. 8 is a front elevational view of mounting and framing apparatus embodying a third modified form of the invention.
Figure 9:
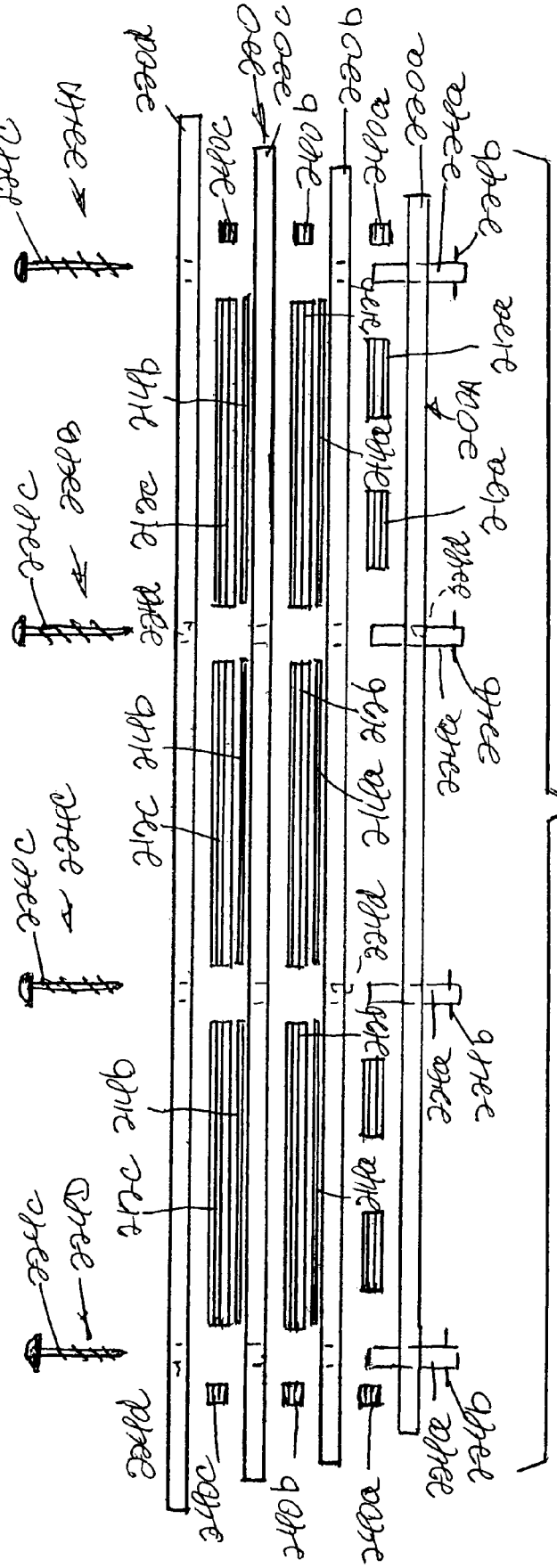
FIG. 9 is an exploded plan view of the modified mounting and framing apparatus of FIG. 8.

The modified mounting and framing apparatus 200 of FIGS. 6 and 7 may be incorporated in a single unit structure of the type disclosed in FIGS. 1-3, or it may be incorporated into a structure of multiple unit type as disclosed in modified mounting and framing apparatus 300 and illustrated in FIGS. 8 and 9, wherein a trio of mounting and framing apparatus 200A, 200B and 200C are disposed in side-by-side relation.

In the form of the invention disclosed in FIGS. 8 and 9, the upper, rigid clamping means 220 of FIGS. 6 and 7 is disposed in spaced, parallel relation to an identical lower, rigid clamping means 220A, with each clamping means extending transversely across each of the mounting and framing apparatus 200A-200C and extending outwardly beyond the outer side edges of apparatus 200A and 200C.

Fastening means 224A, 224B, 224C and 224D, identical to fastening means 224 of FIGS. 6 and 7, interconnect the clamping bars of each damping means 220 and 220A and are disposed at spaced intervals along the length of the clamping means so as to be positioned adjacent the outer vertical edges of each apparatus 200A-200C whereby an even damping force is applied to the transparent plates 212 and to the display material 214 captured in each of said apparatus.

Spacer blocks 240*a*, 240*b* and 240*c* of spacers 240 are positioned between clamping bars 220*a*, 220*b*, 220*c* and 220*d* of clamping means 220 and 220A adjacent the outer free ends of the latter whereby excessive clamping force which might crack or distort the transparent plates 212 is precluded.

It will be apparent that with the invention hereof novel mounting and framing apparatus is provided in which displayed items such as graphics, photographs, mattes, paintings or the like are positioned between transparent layers to impart a sense of depth thereto and in which rigid clamping bars apply a compressive force to the transparent layers for holding the displayed items in place, and decorative members are provided for adding aesthetic appeal.

What is claimed is:

1. Mounting and framing apparatus comprising, at least one set of spaced, transparent plates, said transparent plates being unsealed and unframed, graphic material positioned between the transparent plates, clamping means comprising spaced pairs of rigid clamping bars positioned in bearing relation to the transparent plates, and adjustable fastener means on the clamping means, with adjustment of the fastener means causing the clamping means to apply a compressive force to the transparent plates for retaining the graphic material between the transparent plates and spacer means positioned between the clamping bars and freely movable relative to the clamping bars.

2. Mounting and framing apparatus according to claim 1, wherein the adjustable fastener means comprise mechanical fasteners which extend through the clamping means.

3. Mounting and framing apparatus according to claim 1, wherein the transparent plates are glass, or clear plastic.

4. Mounting and framing apparatus according to claim 1, wherein the graphic material comprises prints, photographs, mattes, or paintings.

5. Mounting and framing apparatus according to claim 1, including multiple sets of transparent plates and wherein the graphic material is positioned between each set of transparent plates.

6. Mounting and framing apparatus according to claim 1, wherein the clamping means extend horizontally across the at least one set of transparent plates.

7. Mounting and framing apparatus according to claim 1, wherein the clamping means extend vertically across the at least one set of transparent plates.

8. Mounting and framing apparatus according to claim 1, including decorative members secured to the clamping means.

9. Mounting and framing apparatus comprising, multiple sets of spaced, transparent plates, said transparent plates being unsealed and unframed, graphic material positioned between each set of transparent plates, clamping means comprising spaced pairs of rigid clamping bars positioned in bearing relation to the transparent plates of each set, and adjustable fastener means on the clamping means, with adjustment of the fastener means causing the clamping means to apply a compressive force to the transparent plates of each set for retaining the graphic material between the sets of transparent plates and spacer means positioned between the clamping bars and freely movable relative to the clamping bars.

10. A method for mounting and framing display material comprising the steps: positioning the display material between the plates of at least one set of spaced, transparent plates, said transparent plates being unsealed and unframed, positioning clamping means comprising spaced pairs of rigid clamping bars in bearing relation to the transparent plates, applying a compressive force to the clamping means, and positioning spacer means between and freely movable relative to the clamping bars for limiting the compressive force applied to the clamping means.

* * * * *